United States Patent [19]

Strodthoff

[11] 4,332,344

[45] Jun. 1, 1982

[54] RESEALABLE PACKAGE

[76] Inventor: Glenn G. Strodthoff, 4808 W. Custer St., Manitowoc, Wis. 54220

[21] Appl. No.: 119,985

[22] Filed: Feb. 8, 1980

[51] Int. Cl.[3] ..... B65D 33/24; B65D 33/38

[52] U.S. Cl. ..... 229/62; 24/201 C; 229/17 G

[58] Field of Search ..... 229/62, 17 G; 150/3; 24/201 C

[56] References Cited

U.S. PATENT DOCUMENTS

| | | | |
|---|---|---|---|
| 1,787,710 | 1/1931 | Wilson | 150/3 |
| 2,093,977 | 9/1937 | Farmer | 229/62 |
| 2,241,834 | 5/1941 | Wentz | 229/17 G |
| 2,929,123 | 3/1960 | Schneideman | 150/3 |
| 3,338,285 | 8/1967 | Jaster | 150/3 |
| 3,361,333 | 1/1968 | Stuart | 229/17 G |

*Primary Examiner*—Stephen P. Garbe
*Attorney, Agent, or Firm*—Keith Schoff

[57] ABSTRACT

Packaging for liquid or granular products is described which has a resealable pouring spout, the mouth of which is banded with rib configurations which engage in tongue-and-groove manner to enable the package to be opened and resealed repeatedly as the packaged contents are incrementally dispensed.

3 Claims, 4 Drawing Figures

RESEALABLE PACKAGE

BACKGROUND OF THE INVENTION

Packaging such as paperboard cartons and film envelopes are commonly provided with a pleated wall or end portion which, when folded inwardly and sandwiched into facing contact serves to close the package, and when opened outwardly, provides a pouring spout. In other packaging a linear closure may be provided by engaging mutually facing rib configurations in the manner of tongue and groove. In still other types, a metal strip with foldable end tabs may be furnished to provide a closure, or a twist tie may be used. However, a resealable pouring spout has not heretofore been known as a part of disposable packaging.

PRIOR ART

A ribbed seal openable by a pull cord is disclosed in U.S. Pat. No. 2,746,502. In U.S. Pat. No. 2,784,087 a resealable plastic bag is shown with folded end pleats which are secured by folded metal end tabs.

SUMMARY OF THE DISCLOSURE

The inner peripheral mouth portion of a pouring spout provided in a carton or packaging envelope as an integral pleat in the wall thereof is banded with inwardly protruding rib configurations disposed to mutually interlock in tongue-in-groove engagement between facing portions of the packaging wall when the pleat is in-folded and closed. The interlocking ribs provide a leak-proof seal which is readily opened and re-sealed by the same manipulation necessary to deploy and close the spout.

DESCRIPTION OF THE INVENTION

Figure 1:
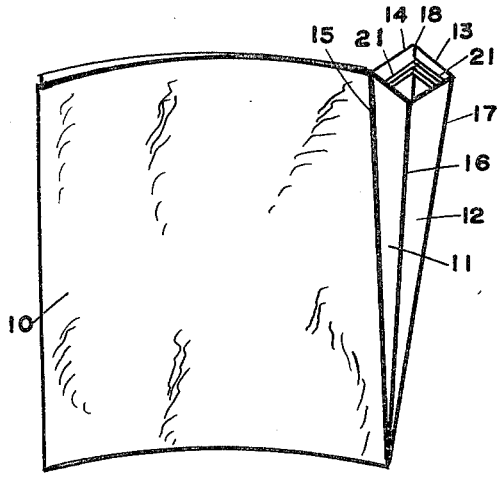
FIG. 1 is a perspective view of one embodiment of a packaging envelope of this invention with the pouring spout shown opened.
Figure 2:
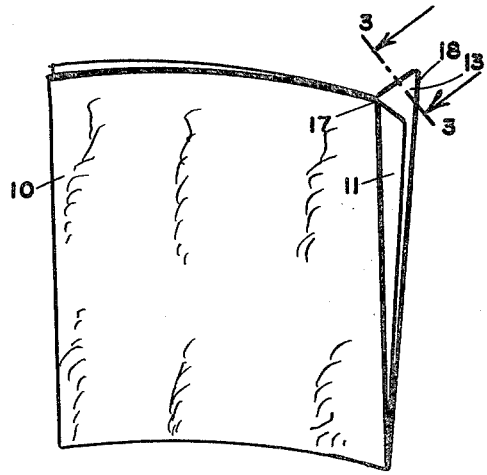
FIG. 2 is a perspective view of the embodiment of FIG. 1 with the pouring spout in-folded and closed and the package sealed.

Referring to FIGS. 1 and 2, package 10 is shown fabricated of flexible plastic sheet or film material and is configured with foldably connected wall portions 11, 12, 13 and 14 which may be outwardly opened as shown in FIG. 1 to provide a mouth at the top of the spout portion formed by the wall portions, and alternately may be in-folded as shown in FIG. 2 to close the mouth of the spout. Further folding of the wing-like projections shown in FIG. 2 into tightly sandwiched facing contact serves to provide a smooth relatively uniformly dimensioned package. Such package means is well known and comprises no part of this invention.

Figure 4:
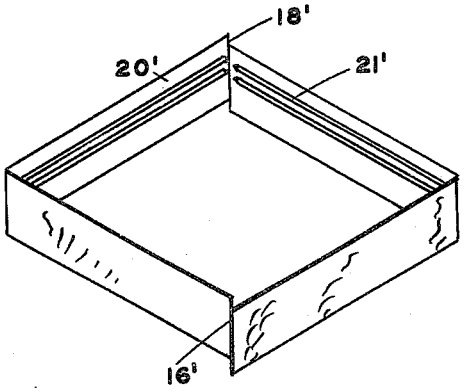
FIG. 4 is a perspective view of a locking rib configured band attachable to the upper peripheral inner wall of a pouring spout.
Figure 3:
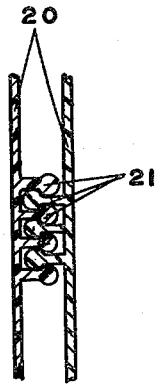
FIG. 3 is a cross sectional elevation of the interlocking ribs of the embodiment of this invention shown in FIGS. 1 and 2 taken along cutting plane 3—3 of FIG. 2.

At least the upper portions of wall portions 11, 12, 13 and 14 are desirably sufficiently stiff to maintain relatively configuration between folds 15, 16, 17, 18 and 19 and lie in smooth facing adjacency rather than be crushed and wrinkled by the manipulation necessary to open and close the spout. Band 20 as shown in FIG. 4 may be used as a stiffener for wall portions 11, 12, 13 and 14 and may preferably comprise molded or extruded synthetic resinous material such s polyethylene, but may also comprise other material such as paperboard, metal foil or other similar material which may be suitable bonded to the wall portions of package 10. Ribs 21 are integrally provided with band 20 and preferably comprise synthetic resinous material which is both plastomeric and lubricous, polyethylene being a preferred material. The configuration of ribs 21 provides an enlarged bead-like edges spaced to produce an interfering fit when the ribs are moved into interlocking engagement in tongue-in-groove manner, the plastomeric material extensibly yielding to provide for operable engagement and effective sealing of the closure produced, sealing engagement being maintained by the faying of the bead-like configurations until the closure is operably opened by manipulation forcing the parting of the seal to unfold the spout. As shown, ribs 21 are mounted on band 20 in sections 25, 26, 27 and 28, one section each disposed along a face of each of wall portions 11, 12, 13 and 14, respectively, with facing pairs of such sections disposed with rib alignment staggered to provide for interlocking engagement when the spout is closed. Preferably sections 26 and 27 are aligned horizontally (and may comprise a continuous length with the ribs notched only at the boundry between sections) and sections 25 and 28 are similarly aligned horizontally. So aligned, ribs 21 of sections 27 and 28 will interlock as shown in FIG. 3 to provide a leakproof seal for package 10. Ribs 21 on sections 25 and 26 will similarly engage when the spout is closed.

Band 20 may either be configured as a continuous substrate ribbon with ribs 21 fused thereto or may comprise individual sections of unitarily extruded substrate and rib structure. It may be possible to provide band and rib structure as a continuous extrusion for the four faces of the spout, but the provision of such means is not preferred. Rather, it is preferred to provide two lengths of unitarily extruded band 20 and rib 21 structure, one for being bonded on sections 26 and 27, and the other for being bonded on sections 25 and 28. Preferably the ribs 21 are operably notched at the situs of folds 15 and 17 and slight gaps provided between the ends of bands 20 at the situs of folds 16 and 19 to properly accommodate the increase in bulk provided to the mouth of package 10 by the inclusion of band 20 and rib 21 structure. The sizing the notches and gaps necessary to provide a tight seal will depend on the thickness of the package wall and of the band and rib configuration and is best determined by modeling the closure or by trial and error experimentation.

In FIG. 3, multiple number of ribs are provided in facing relationship, namely three ribs 21 on one of the two band 20 portions, and four on the other, however, any other number of ribs might be provided to a minimum of one rib being provided on one facing band and two on the other. An equal number of rib structures might be provided on the two band segments, and this is preferred to enable the closure to be provided from identical sections of band and rib structure, which can be provided from a single die extrusion. With increasing numbers of rib configurations which interlock, the holding power securing a seal may be maintained or increased while the profile of the ribs is decreased in size either to lessen the bulk or to reduce the size of the groove opening between ribs to better shed granules of material which are to be dispensed from the package containing the closure means.

In FIG. 4 a continuous length of band 20' is shown provided from a single ribbon from an extrusion die with one set of oppositely disposed corner junctures 16', 18' operably offset to stagger the alignment of adjacent runs of ribs 21' by the extruded polyethylene material being softened by the application of a hot wire laid transversely thereon enabling the run of ribbon to be offset transversely at the situs of the softening under the wire to operable stagger the alignment of adjacent runs of ribs 21'. Other operable process and means might also suggest themselves to one skilled in the art.

The resealable closure of this invention may be employed in conjunction with a separate tear strip packaging seal disposed above the resealable closure, such packaging seals being well known in the art. Other types of packaging seals may also be conveniently used in conjunction with the herein described invention, such as those made by folding over a portion of a paperboard wall of carton, such as commonly used for milk, across a peaked top configuration and stapling it in place to seal the carton top, which is then opened by tearing the paperboard folded-over flap along the fold line. In other packaging the resealable closure of this invention may be operably used for a closure in a box liner such as commonly used for breakfast cereal and the like where a waxed paper liner or the like is loosely fitted within a paperboard box, the box liner being resealable to preserve the freshness of the package contents during the period of time that the box is open.

I claim:

1. A packaging container for liquid or for granular solids and incorporating a re-closable pouring spout formed by pleat folded sections of the package well being disposed to lie in face-to-face contact when infolded and to provide an open mouthed pouring spout when outwardly folded, an improvement to render the package repeatedly resealable comprising elongated rib means disposed on the inner faces of said folded sections, protruding from said faces and disposed on members of said facing sections which infold, in staggered alignment with those on sections next adjacent thereto to mutually intermesh as tongue and groove when said sections are placed in contacting facing adjacency operably to close said spout, said rib means being of plastomeric material and configured with enlarged bead-like edges to provide a leak proof seal when operably engaged.

2. The apparatus of claim 1 wherein at least one said rib is provided on the face of two first wall sections and wherein at least two said ribs are provided parallelly disposed on the face of each of two second said wall sections which oppositely face said two first wall sections when said spout is infolded and closed and interengage therewith.

3. The apparatus of claim 1 wherein multiple numbers of said ribs are provided on each said wall section disposed to operable engage and interlock.

* * * * *